US007083565B2

(12) United States Patent
Hermeler et al.

(10) Patent No.: US 7,083,565 B2
(45) Date of Patent: Aug. 1, 2006

(54) SOLID-BOWL CENTRIFUGE HAVING A DISK STACK ON THE DRUM COVER

(75) Inventors: Jürgen Hermeler, Haltern (DE); Paul Brüning, Oelde (DE); Ludger Horstkötter, Ennigerloh (DE)

(73) Assignee: Westfalia Separator AG, Oelde (DE)

( * ) Notice: Subject to any disclaimer, the term of this patent is extended or adjusted under 35 U.S.C. 154(b) by 420 days.

(21) Appl. No.: 10/451,949

(22) PCT Filed: Oct. 23, 2001

(86) PCT No.: PCT/EP01/12196

§ 371 (c)(1),
(2), (4) Date: Oct. 14, 2003

(87) PCT Pub. No.: WO02/051550

PCT Pub. Date: Jul. 4, 2002

(65) Prior Publication Data

US 2006/0142137 A1 Jun. 29, 2006

(30) Foreign Application Priority Data

Dec. 27, 2000 (DE) ..... 100 65 060

(51) Int. Cl.
*B04B 1/20* (2006.01)
*B04B 1/08* (2006.01)

(52) U.S. Cl. ..... 494/53

(58) Field of Classification Search ..... 494/50–56, 494/68–73; 210/380.1, 380.3
See application file for complete search history.

(56) References Cited

U.S. PATENT DOCUMENTS 2,057,156 A * 10/1936 Lyons ..... 204/515
2,622,794 A * 12/1952 Smith ..... 494/53
2,625,320 A * 1/1953 Lyons ..... 494/37
2,711,854 A * 6/1955 Kjellgren ..... 494/27
2,743,864 A * 5/1956 Lyons ..... 494/54
4,009,823 A * 3/1977 Nozdrovsky ..... 494/27
4,042,172 A * 8/1977 Nozdrovsky ..... 494/53
4,209,128 A * 6/1980 Lyons ..... 494/37
5,182,020 A * 1/1993 Grimwood ..... 210/512.1
5,310,399 A 5/1994 Suzuki
5,314,399 A * 5/1994 Suzuki ..... 494/54
5,364,335 A * 11/1994 Franzen et al. ..... 494/15

(Continued)

FOREIGN PATENT DOCUMENTS

DE 14 82 721 6/1969

(Continued)

*Primary Examiner*—Charles E. Cooley

(74) *Attorney, Agent, or Firm*—Barnes & Thornburg LLP

(57) ABSTRACT

The present invention is a solid-bowl screw centrifuge that includes a centrifugal drum. The drum has a drum casing and a screw with a screw body that is surrounded by a screw blade. The screw blade forms at least one screw spiral with a conveying path for transporting material to be centrifuged. The centrifuge also includes an inlet into the centrifugal drum, at least one solid matter discharge and at least one liquid outlet. The centrifuge includes a drum chamber that is axially closed by a drum cover having essentially a conical shape. Further included is a disk stack having at least one conical disk, and the disk stack is mounted to the drum cover directly upstream of the liquid outlet. At least a portion of the disk stack is arranged in a cylindrical section of the drum chamber that has an essentially constant diameter. A screw disk is arranged on the screw body between the drum cover and a first screw spiral.

21 Claims, 2 Drawing Sheets

U.S. PATENT DOCUMENTS

| | | | | |
|---|---|---|---|---|
| 6,030,332 | A | 2/2000 | Hensley | |
| 6,537,191 | B1 * | 3/2003 | Stroucken et al. | 494/53 |
| 6,712,751 | B1 * | 3/2004 | Stroucken et al. | 494/53 |
| 6,716,153 | B1 * | 4/2004 | Stroucken et al. | 494/53 |

FOREIGN PATENT DOCUMENTS

| | | | |
|---|---|---|---|
| DE | 26 17 692 | | 11/1977 |
| DE | 43 20 265 | | 12/1994 |
| EP | 0 806 245 | | 4/1996 |
| FR | 1 449 064 | | 7/1966 |
| FR | 2 532 198 | | 8/1982 |
| GB | 998 669 | | 7/1965 |
| IT | 496031 | | 6/1954 |
| SU | 385 629 | | 10/1973 |
| SU | 1438067 | A2 * | 1/1995 |
| SU | 1656741 | A2 * | 1/1995 |
| WO | WO 98/45045 | | 10/1998 |
| WO | WO 99/52641 | | 10/1999 |
| WO | 02/051550 | A1 * | 7/2002 |

* cited by examiner

SOLID-BOWL CENTRIFUGE HAVING A DISK STACK ON THE DRUM COVER

BACKGROUND AND SUMMARY OF THE INVENTION

The invention relates to solid-bowl screw centrifuges.

It is known from the prior art to provide disk arrangements in solid-bowl screw centrifuges.

U.S. Patent Document U.S. Pat. No. 5,310,399 shows disks which are arranged on the screw body, specifically between several spirals of the screw.

A similar construction is known from German Patent Document DE 26 17 692. Also, in this multi-stage decanter arrangement, the disks are arranged on the screw.

In addition, there are constructions in which a type of disk drum is connected behind the actual decanter drum (see, for example, IT 496 031 or SU 385 629).

Additional known combinations of solid-bowl screw centrifuges with disk inserts are known from International Patent Document WO 98/45045, French Patent Document 1 449 064, French Patent Document 2 532 189 and British Patent Document GB 998 669.

In British Patent Document GB 998 669, a type of a complete separator is connected on the output side of the decanter as a constructional unit. As a result, the after clarification of the product preclarified in the decanter basically takes place in a completely separate series connection of the decanter and the separator.

In the separator with the stack of disks, the concentrate is discharged on a larger diameter of the nozzles and the clarified phase is discharged in the center. Outside the stack of disks, a solid matter space is constructed which is bounded on both sides by conical walls. The outside diameter of this separator, for example, in SU 385 629 or GB 998 669, is situated on a larger radius than the outside diameter of the decanter.

The initially mentioned decanter constructions with integrated disk stacks are distinguished in that the disk stacks are each mounted on the screw bodies and thus rotate at a differential rotational speed with respect to the drum casing. This necessarily results in disturbing gaps. Furthermore, no optimal utilization of the space can be accomplished.

From International Patent Document WO 99/52641 (as well as parallel U.S. Patent Document U.S. Pat. No. 6,030,332), it is known to mount a disk stack directly upstream of the liquid outlet, so that it is arranged on the drum cover. However, in this case, it is problematic that the disk stack essentially fills out the cylindrical area of the centrifuge, so that, differently than in British Patent Document GB-A-998669, a separator is not connected to the output side of a complete decanter, which first develops its effect. A similar construction as that of U.S. Patent Document U.S. Pat. No. 6,030,322 is illustrated in German Patent Document DE 1 482 721.

An aspect of the present invention is a centrifuge that has a discharge of concentrate take place from an area of a disk stack toward a drum casing.

The present invention is a solid-bowl screw centrifuge that includes a centrifugal drum. The drum has a drum casing and a screw with a screw body that is surrounded by a screw blade. The screw blade forms at least one screw spiral with a conveying path constructed between the at least one screw spiral for transporting material to be centrifuged. The centrifuge also includes an inlet into the centrifugal drum, at least one solid matter discharge and at least one liquid outlet. The centrifuge also includes a drum chamber that is axially closed by a drum cover having essentially a conical shape. Further included is a disk stack having at least one conical disk, and the disk stack is mounted to the drum cover directly upstream of the liquid outlet. At least a portion of the disk stack is arranged in a cylindrical section of the drum chamber that has an essentially constant diameter. A screw disk is arranged on the screw body between the drum cover and a first screw spiral of the at least one screw spiral. The screw disk has an interior section and a conical exterior section.

The conical section of the screw disk as well as the conical drum cover constructed opposite the conical section of the screw disk thereby form a solid matter or concentrate collecting space which is conically tapered twice. That permits a draining of the concentrate toward the drum casing without requiring a joining of a separately constructed separator connected to the output side of the decanter. For at least this purpose, the disk stack is arranged in a cylindrical section of the drum chamber with an essentially constant diameter and the disk stack is mounted directly upstream of the liquid outlet, while resting on the drum cover and/or being arranged on the latter.

Since the stack of disks rests directly on the drum cover or is fastened thereto, it no longer rotates at a differential rotational speed with respect to the drum casing but rotates together with it.

In contrast to disk inserts on the screw, a disk insert or stack of disks connected with a liquid-side drum casinggenerally prevents disturbing short-circuit connections from occurring between a clear-phase collecting pipe of the disk stack and a solid matter or concentrate space outside the disk stack. The concentrate space of the disk stack is situated on the outside on the disk stack, in which the diameter of the drum casing can be constructed to be continuous or constant and requires no widening. In this manner, mixtures which are difficult to clarify, for example, mixtures with fine suspended matter, can be separated.

The maximal radial dimension of the screw disk is preferably smaller than the radial dimension of the screw blade. In particular, discharge is achieved by a removal device on the first screw blade which penetrates the screw disk.

The drum cover preferably has an essentially conical construction, which permits a fastening of the preferably preassembled disk stack on the drum cover, particularly since the disks of the stack of disks also have a preferably conical construction.

According to an embodiment of the present invention, a clear-phase collecting pipe is situated at a lower diameter than the exterior wall of the screw body.

The screw disk, located between the first screw spiral, as viewed from the drum cover, and the drum coverhas a disk-type interior section and a conical exterior section. The maximal radial dimension of the screw disk is smaller than the radial dimension of the screw blade. The conical section of the screw disk as well as the conical drum cover constructed opposite the conical section of the screw disk thereby form the solid matter or concentrate collecting space which is conically tapered twice and which permits a draining of the concentrate toward the drum casing by a removal device at the first screw blade which penetrates the screw disk.

The invention will be better understood and appreciated from the following detailed descriptions and with reference to the accompanying drawings.

DETAILED DESCRIPTION OF THE PREFERRED EMBODIMENTS

Figure 1:
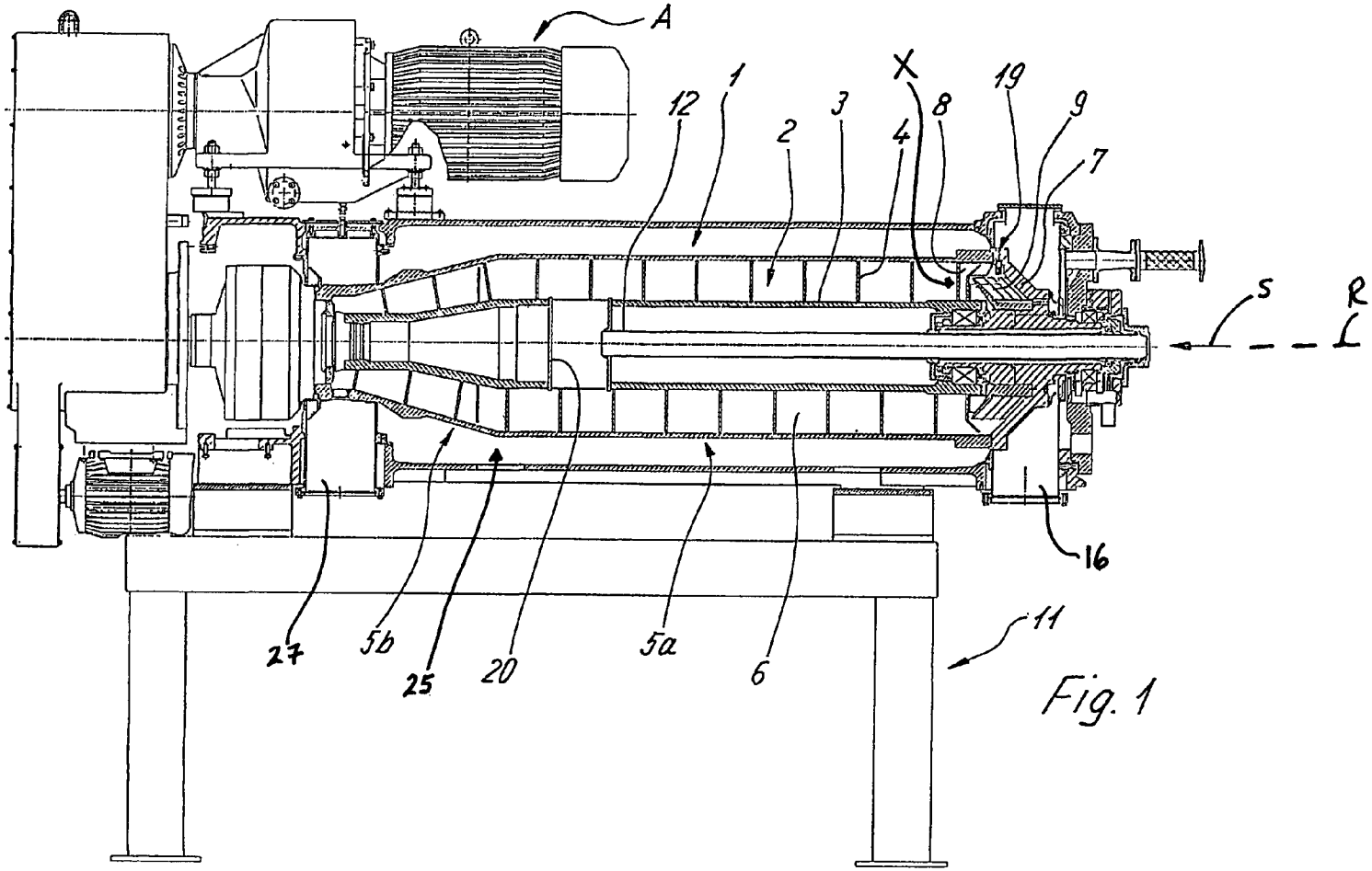
FIG. 1 is a sectional view of a solid-bowl screw centrifuge, according to the principles of the present invention.

FIG. 1 shows a solid-bowl crew centrifuge having a drive A and a machine frame M. The centrifuge also includes a centrifugal drum 25 with a drum casing 1 and a screw 2. The screw 2 includes a screw body 3 as well as a screw blade 4 surrounding the screw body 3 and forming at least one screw spiral X. Between the at least one screw spiral X, a conveyer path is constructed for conveying/transporting a material S to be centrifuged.

The screw body 3 has a cylindrical section 5*a*, which is slightly stepped in a rearward area (to the right as viewed in FIG. 1), and an adjoining conically tapering section 5*b*. The cylindrical section 5*a* is axially closed off by a drum cover 7 which has a conical construction at least in an area of a drum chamber 6 between the screw body 3 and the drum casing 1.

The operation of this solid-bowl screw centrifuge is as follows.

The material S to be centrifuged is guided through a centrally arranged as well as co-rotating inlet pipe 12 by a distributor 20 into the drum chamber 6. As a result of the force of gravity, solid matter particles deposit in a very short time on an interior wall of the rotating drum casing 1. The distributor 20 and the co-rotating inlet pipe 12 form a largely tight system.

The screw 2 rotates at a slightly lower or higher speed than the drum 1 and conveys centrifuged solid matter toward the conical section 5*b* out of the drum 25 to a solid matter outlet 27.

Figure 2:
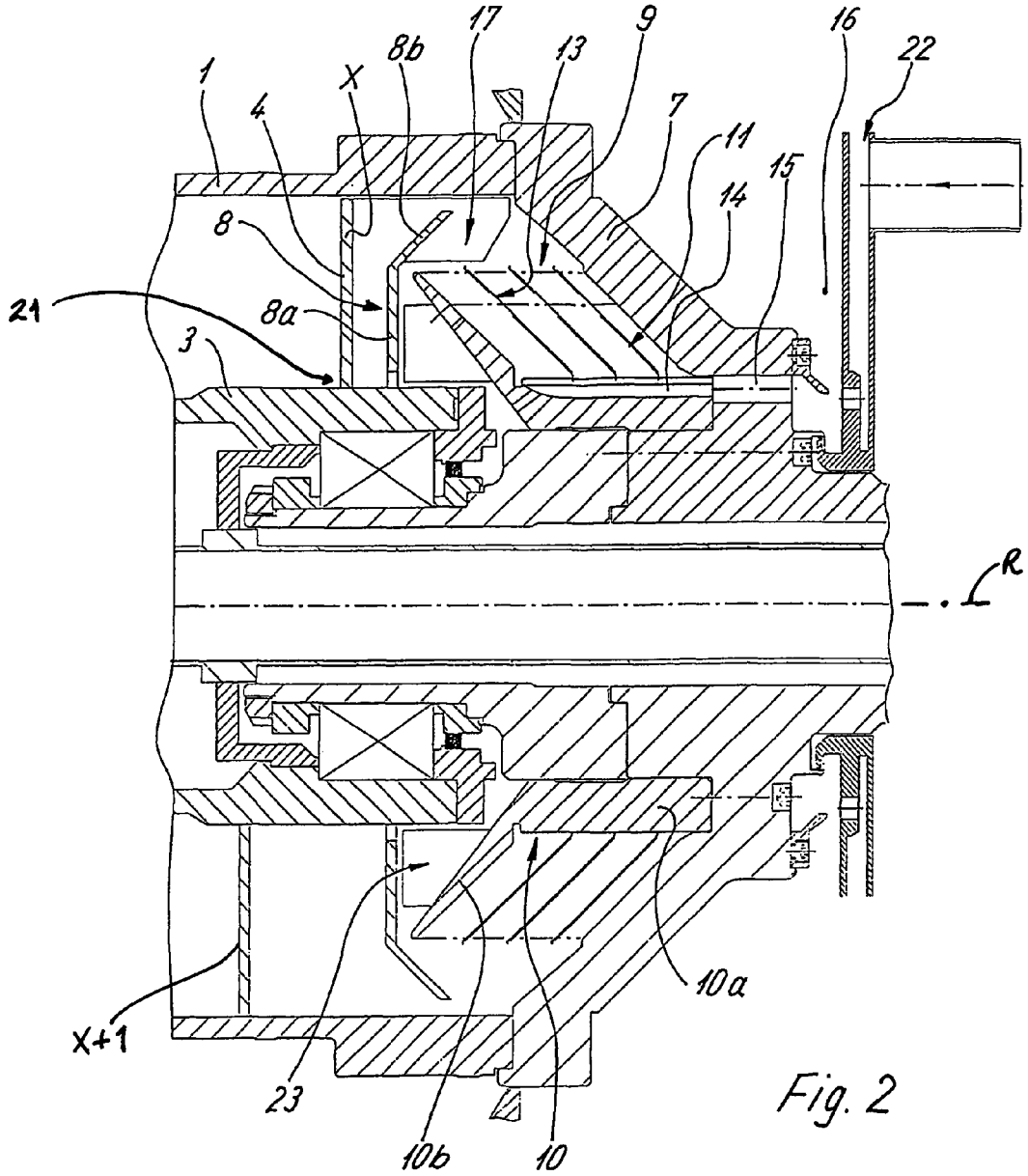
FIG. 2 is a sectional view of a portion of the solid-bowl screw centrifuge of FIG. 1.

In contrast, liquid flows toward the cylindrical section 5*a* at the rearward end of the drum 1 (to the right as viewed in FIG. 1) and is discharged there via outlet 16 (as shown FIG. 2).

As shown in FIGS. 1 and 2, between first screw spiral X, and drum cover 7, a screw disk 8 is arranged on and near an end of the screw body 3. Screw disk 8 has a disk-type interior section 8*a* and preferably a stabilizing, conical exterior section 8*b*. The maximal radial dimension of the disk 8 is smaller than the radial dimension of the screw blade 4. At the inside diameter of the screw disk 8, at least one opening or ring gap 21 is provided for a passing-through of the liquid.

Between the screw disk 8 and the drum cover 7, a stack 9 of disks 11 is arranged. The stack 9 may be constructed as a unit which can be preassembled and fastened directly to an interior side of the drum cover 7. The stack 9 of disks 11 has a holding device 10 shaped in a manner of a distributor, which holding device 10 has an interior cylindrical section 10*a* and an axially adjoining conical section 10*b*. Between the conical section 10*b* and the drum cover 7, the conical disks 11 are arranged and preferably spaced by spacers (not shown) which are adapted for a particular application. The spacers may be molded-on strips, punctiform spacers, or equivalent. The conical disks 11 are preferably constructed to essentially correspond to the conical shape of the drum cover 7.

In an exterior area of the disks 1, ascending ducts 13 are constructed which penetrate the conical section 10*b*. As an alternative, the stack 9 of disks 11 may be constructed such that a feeding of the material S to be centrifuged or clarified takes place radially from the outside of the centrifuge (not shown).

A draining-off of a clear or liquid phase takes place by a collecting pipe 14 at an interior diameter of the disks 11 in a wall of the cylindrical section 10*b*.

The collecting pipe 14 is preferably situated at least partially on a smaller diameter, relative to the axis of rotation R, than an exterior wall of the screw body 3, which results in a more energy-saving operating mode than an arrangement of the collecting pipe 14 on a larger diameter of the exterior wall. Such an alternative arrangement, however, is also conceivable. The collecting pipe 14 axially extends into a bore 15 of the drum cover 7 which bore 15 leads into a radially outward extending outlet 16 for discharging the clear or liquid phase.

A concentrate space is situated on an outside area at the stack 9 of disks 11, where the diameter of the drum casing 1 has a continuous construction and needs no widening. A concentrate discharge takes place by the screw 2. For discharging solid matter from the concentrate space, the screw 2 has a removal projection 17 which penetrates the disk 8. The diameter of the drum casing 1 is essentially constant in this concentrate space.

For adjusting the liquid level in the drum 25, known systems, such as the applicant's Varipond System, can be used as shown in German Patent Document DE 43 20 265. For instance, regulating disk 22 can be slid on axially adjacent outlet 16. Other adjusting possibilities of the liquid level are conceivable, such as a trailing blade disk (not shown) connected behind the disk stack 9.

On the holding device 10 and/or on the drum cover 7, ribs 23 are constructed on a side facing away (to the left in FIG. 2) from the disks 11, which ribs 23 promote introduction of the material S to be centrifuged into the disk stack 9.

An operation of the centrifuge is as follows. The material S to be centrifuged passes through the ring gap 21 and flows along the ribs 23 into the ascending ducts 13 of the disk stack 9. Here the clear phase or liquid is drained to the collecting pipe 14 and the solid matter is discharged to the outside. The solid matter is taken along by the removal projection 17 and is conveyed by the screw 2 to the conical section 5*b*.

The disk stack 9 can be cleaned by a flush-back device. As required, a cleaning effect can be promoted by an evacuation by a nozzle (not shown) in the outlet 16 or a centrifugal force valve 19.

Spacing between one or more of the disks 11 of the stack 9 is preferably more than 0.5 mm and less than 3 mm, measured perpendicularly to the surface of the disks 11. An angle of slope of the conical disks 11 with respect to the drum axis R is between 35° and 55°, and preferably between 40° to 50°.

Preferably, a diameter or maximal radial dimension of the disks 11 at an outer edge amounts to approximately 50 to 75%, and preferably ⅔ of a diameter of a free screw area or radial space between the screw body 3 and the drum casing 1, or of a radial space of the drum chamber 6.

Although the present disclosure has been described and illustrated in detail, it is to be clearly understood that this is done by way of illustration and example only and is not to be taken by way of limitation. The spirit and scope of the present disclosure are to be limited only by the terms of the appended claims.

We claim:

1. A solid-bowl screw centrifuge, comprising:

a centrifugal drum having a drum casing and a screw, the screw having a screw body surrounded by a screw blade forming at least one screw spiral with a conveying path constructed between the at least one screw spiral for transporting material to be centrifuged;

an inlet into the centrifugal drum;

at least one solid matter discharge;

at least one liquid outlet;

a drum chamber axially closed by a drum cover having essentially a conical shape;

a disk stack having at least one conical disk, the disk stack being mounted to the drum cover directly upstream of the liquid outlet and at least a portion of the disk stack being arranged in a cylindrical section of the drum chamber that has an essentially constant diameter; and a screw disk arranged on the screw body between the drum cover and a first screw spiral of the at least one screw spiral, the screw disk having an interior section and a conical exterior section.

2. The solid-bowl screw centrifuge according to claim 1, wherein the conical disks are constructed to essentially correspond to the conical shape of the drum cover.

3. The solid-bowl screw centrifuge according to claim 1, wherein the disk stack has a collecting pipe for a clarified liquid phase, and the disk stack is at least partially situated closer radially to a rotational axis of the centrifugal drum than an exterior wall of the screw body.

4. The solid-bowl screw centrifuge according to claim 1, wherein a maximal radial dimension of the screw disk is smaller than a radial dimension of the screw blade.

5. The solid-bowl screw centrifuge according to claim 1, wherein at least one opening is constructed on an inside diameter of the screw disk for the passing-through of a liquid.

6. The solid-bowl screw centrifuge according to claim 1, wherein the disk stack is constructed between the screw disk and the drum cover.

7. The solid-bowl screw centrifuge according to claim 1, wherein the disk stack has a holding device which includes an interior cylindrical section and an axially adjoining conical section, the at least one conical disk being arranged between the axially adjoining conical section and the drum cover.

8. The solid-bowl screw centrifuge according to claim 7, wherein ascending ducts are constructed in an exterior area of the at least one conical disk, which ascending ducts penetrate the conical section of the holding device.

9. The solid-bowl screw centrifuge according to claim 7, wherein at least one collecting pipe is constructed in the cylindrical section of the holding device.

10. The solid-bowl screw centrifuge according to claim 9, wherein the at least one collecting pipe leads into an outlet through a bore of the drum cover.

11. The solid-bowl screw centrifuge according to claim 1, wherein ribs for introducing the material to be centrifuged into the disk stack are joined to one of the holding device on a side facing away from the at least one conical disk and to the drum cover.

12. The solid-bowl screw centrifuge according to claim 1, wherein the disk stack is arranged such that the feeding of the material to be centrifuged takes place radially from outside the centrifuge.

13. The solid-bowl screw centrifuge according to claim 1, wherein the screw has a removal projection for discharging solid matter from a concentrate space.

14. The solid-bowl screw centrifuge according to claim 1, wherein the inlet is configured such that it rotates along with the screw.

15. The solid-bowl screw centrifuge according to claim 1, wherein the at least one conical disk includes at least two conical disks and a spacing between each of the at least two conical disks is between approximately 0.5 and 3 mm, as measured perpendicularly to a surface of the at least one conical disk.

16. The solid-bowl screw centrifuge according to claim 1, wherein an angle of slope of the at least one conical disk, with respect to a rotational axis of the drum, is between 35° and 55°.

17. The solid-bowl screw centrifuge according to claim 1, wherein a maximal radial dimension of the at least one conical disk is approximately between 50 and 75% of one of a radial space between the screw body and the drum casing and a radial space of the drum chamber.

18. The solid-bowl screw centrifuge according to claim 1, wherein a maximal radial dimension of the at least one conical disk is approximately ⅔ of one of a radial space between the screw body and the drum casing and a radial space of the drum chamber.

19. The solid-bowl screw centrifuge according to claim 1, further including one or more of a flush-back device, a centrifugal valve and a nozzle for cleaning at least a portion of the centrifuge.

20. The solid-bowl screw centrifuge according to claim 1, further including a regulating disk slidable axially in front of the liquid outlet for regulating a liquid level.

21. The solid-bowl screw centrifuge according to claim 1, wherein an angle of slope of the at least one conical disk, with respect to a rotational axis of the drum, is between 40° and 50°.

* * * * *